US010788195B1

(12) United States Patent
You

(10) Patent No.: US 10,788,195 B1
(45) Date of Patent: Sep. 29, 2020

(54) RAPID AND SIMPLE LED DISPLAY LIGHT BOX

(71) Applicant: Shanghai Edgelight Industry Co., Ltd., Shanghai (CN)

(72) Inventor: Lei You, Shanghai (CN)

(73) Assignee: Shanghai Edgelight Industry Co., Ltd., Shanghai (CN)

( * ) Notice: Subject to any disclaimer, the term of this patent is extended or adjusted under 35 U.S.C. 154(b) by 0 days.

(21) Appl. No.: 16/541,609

(22) Filed: Aug. 15, 2019

(30) Foreign Application Priority Data

Apr. 11, 2019 (CN) ..... 2019 1 0289240

(51) Int. Cl.
*F21L 4/04* (2006.01)
*F21V 23/00* (2015.01)
*F21S 8/00* (2006.01)

(52) U.S. Cl.
CPC ..... *F21V 23/003* (2013.01); *F21L 4/04* (2013.01); *F21S 8/037* (2013.01)

(58) Field of Classification Search
CPC ..... F21L 4/04
USPC ..... 362/612
See application file for complete search history.

(56) References Cited

U.S. PATENT DOCUMENTS 9,822,964 B2 * 11/2017 Moreau ..... F21V 33/0084
2015/0370146 A1 * 12/2015 Johnson ..... G03B 15/07 396/4
2016/0282705 A1 * 9/2016 Johnson ..... G03B 15/06

FOREIGN PATENT DOCUMENTS

KR 101938373 B1 * 1/2019

* cited by examiner

*Primary Examiner* — Christopher M Raabe
(74) *Attorney, Agent, or Firm* — Blank Rome LLP

(57) ABSTRACT

A rapid and simple LED display light box includes a base, a support rod and a top supporting element. One end of the support rod can be fixed to the base while the other end thereof is connected to the top supporting element. An LED light bar can be arranged on the base and/or the top supporting element. The LED light bar can be lightened by a storage battery system under the places without power facilities. The light source with the LED light bar supports multiple mounting modes and can meet requirements of various brightness. The structure is firm, assembly is rapid, and collection is simple.

13 Claims, 5 Drawing Sheets

RAPID AND SIMPLE LED DISPLAY LIGHT BOX

RELATED APPLICATION

This application claims benefit of priority of China Patent Application No. 201910289240.0, filed Apr. 11, 2019, entitled: RAPID AND SIMPLE LED DISPLAY LIGHT BOX. The above-identified, related application is incorporated herein by reference in its entirety.

FIELD OF USE

The present invention relates to a simple display light box, and in particular, to a rapid and simple LED display light box applicable to convenience stores, supermarkets or other similar places.

BACKGROUND OF THE INVENTION

Currently, the LED advertising light box is rapidly developed. However, the LED advertising light box has such a large size that it cannot be detached by a non-specialized person; or even though the light box is completely detached, it cannot be assembled by a person without professional training; or there are some light boxes which cannot be detached or assembled without special tools; furthermore, an assembled light box has troublesome problems of transporting and handling; therefore, a portable, rapidly assembled, simply detached and conveniently collected light box structure capable of being carried by one person and being rapidly built up anytime anywhere is increasingly required by the exhibition and display market.

A roll up display stand as a rapid and simple display light box is popular in customers. However, the traditional roll up display stand has a defect that it does not have a lighting device, so its picture cannot achieve an attractive effect under the irradiation of an LED light. Especially, people may be even hard to see the displayed content of the picture clearly in some dark places or in an overcast-weather state.

Therefore, it especially needs a rapid and simple LED light box to solve the above existing problems.

SUMMARY OF THE INVENTION

An objective of the present invention is to provide a rapid and simple LED display light box. By aiming at defects in the prior art, the rapid and simple LED display light box attaches an LED light source so as to improve its display effect and not be influenced by dark environment, and also has a storage battery system to power an LED light bar under places without electric power facilities. Therefore, the rapid and simple LED display light box is more convenient in mobile exhibition, has various light source mounting manners and a firm structure, is easy to be built up, is rapidly assembled and is simply collected.

The technical problem solved by the present invention can be achieved by the following technical solution.

A rapid and simple LED display light box includes a base, a support rod and a top supporting element, wherein one end of the support rod is fixed to the base while the other end thereof is connected to the top supporting element, and an LED light bar is arranged on the base and/or the top supporting element.

In an embodiment of the present invention, a storage battery system is arranged in the base, the storage battery system and the LED light bar are interconnected, and the storage battery system is a lead-acid battery or a lithium battery.

In an embodiment of the present invention, the shape of a side face of the rapid and simple LED display light box includes, but is not limited to, a rectangle, a trapezoid and a triangle.

In an embodiment of the present invention, the LED light bar has at least one row of LED beads.

In an embodiment of the present invention, the LED light bar is adjustably embedded in the base and/or the top supporting element.

In an embodiment of the present invention, the LED light bar is rotatably fixed to the exterior of the base and/or the top supporting element.

In an embodiment of the present invention, the LED bead on the LED light bar includes, but is not limited to, a bare LED bead, a primary optical LED bead and a secondary optical LED bead.

Further, the shape of a lens of the secondary optical LED bead includes, but is not limited to, a circle, an ellipse and a rectangle.

In an embodiment of the present invention, the rapid and simple LED display light box has a one-sided uniaxial, double-sided uniaxial or double-sided biaxial structure.

In an embodiment of the present invention, there is at least one support rod.

In an embodiment of the present invention, the support rod has a retractable structure or a folding-collection type structure.

In an embodiment of the present invention, the top supporting element has a rectangular structure formed by splicing support rod structures, supporting plate structures or tube-shaped structures.

In an embodiment of the present invention, seals are arranged on two sides of the rapid and simple LED display light box, and the seals are fixed using a hook-and-loop fastener, a zipper or a roller shutter.

Further, a roller of the roller shutter is mounted on a side face of the top supporting element or the base.

The rapid and simple LED display light box of the present invention is easy to be built up like the traditional roll up display stand structure, has the light source with the LED light bar so as to improve the display effect and not be influenced by the dark environment, and also has a storage battery system which avoids the need of wiring for power supply and be convenient to move anytime; the LED light bar can be lightened by the storage battery system under the places without power facilities; the light source with the LED light bar supports multiple mounting modes and can meet requirements of various brightness; and the structure is firm, assembly is rapid, collection is simple, and the objective of the present invention is achieved.

Features of the present invention can be clearly understood by referring to the drawings and detailed description of the following better embodiments.

DETAILED DESCRIPTION OF THE ILLUSTRATED EMBODIMENTS

To make technical means, creation features, objectives, and effects of the present invention clearer and more comprehensible, the present invention is further described below with reference to the specific drawings.

Embodiment

Figure 1:
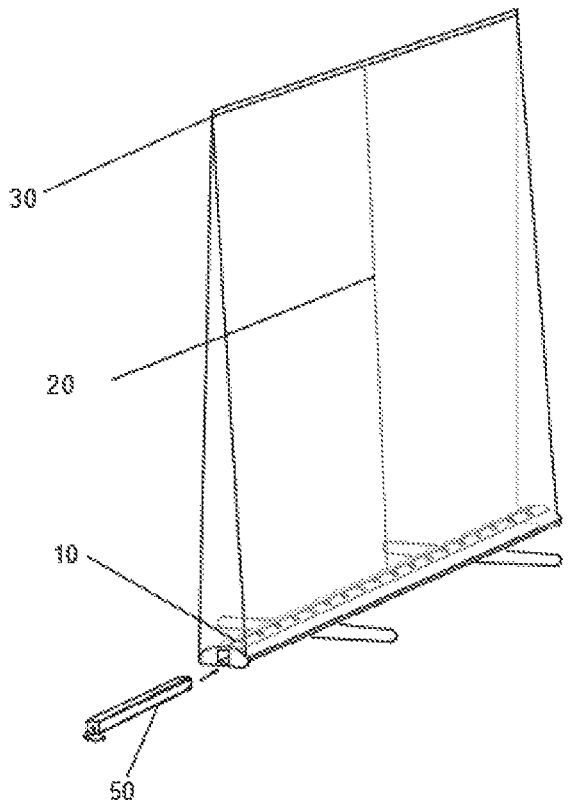
FIG. 1 is a schematic structural diagram of a rapid and simple LED display light box of the present invention.
Figure 2:
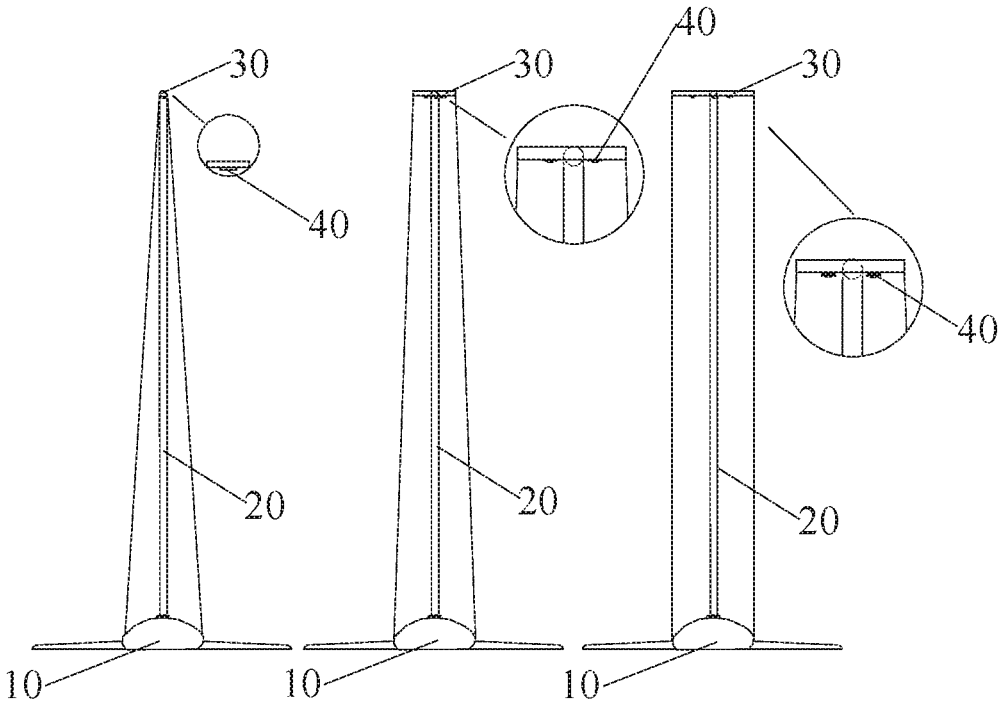
FIG. 2 is a schematic structural diagram of a mounting structure of an LED light bar of the present invention.
Figure 3:
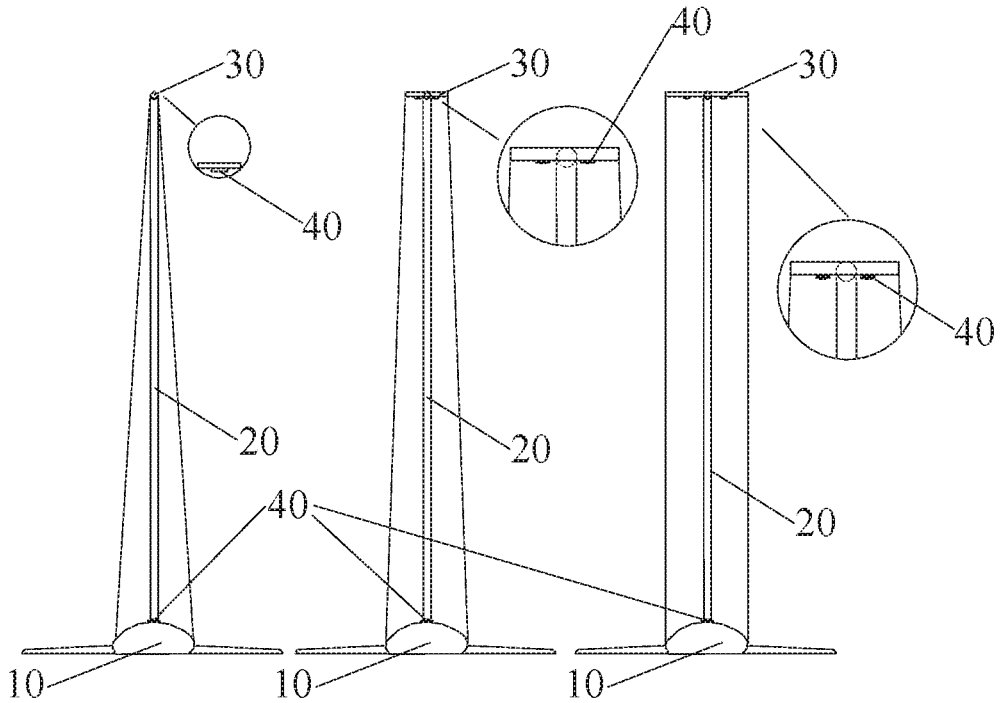
FIG. 3 is a schematic structural diagram of a mounting structure of another LED light bar of the present invention.

As shown in FIG. 1 to FIG. 3, the rapid and simple LED display light box of the present invention includes a base 10, a support rod 20 and a top supporting element 30, one end of the support rod 20 is fixed to the base 10 while the other end thereof 20 is connected to the top supporting element 30, and an LED light bar 40 is arranged on the base 10 and/or the top supporting element 30.

In the embodiment, the rapid and simple LED display light box of the present invention can be one-sided or double-sided.

In the embodiment, the top supporting element 30 has a rectangular structure formed by splicing support rod structures, supporting plate structures or tube-shaped structures. When the rapid and simple LED display light box of the present invention is double-sided, the shape formed by a side face of the rapid and simple LED display light box includes, but is not limited to, a rectangle, a trapezoid and a triangle according to different shapes and sizes of the top supporting element 30.

Figure 4:
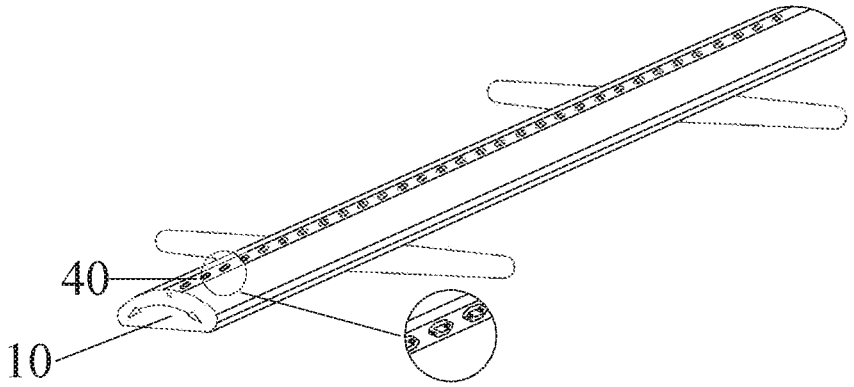
FIG. 4 is a schematic structural diagram of an LED light bar of the present invention.
Figure 5:
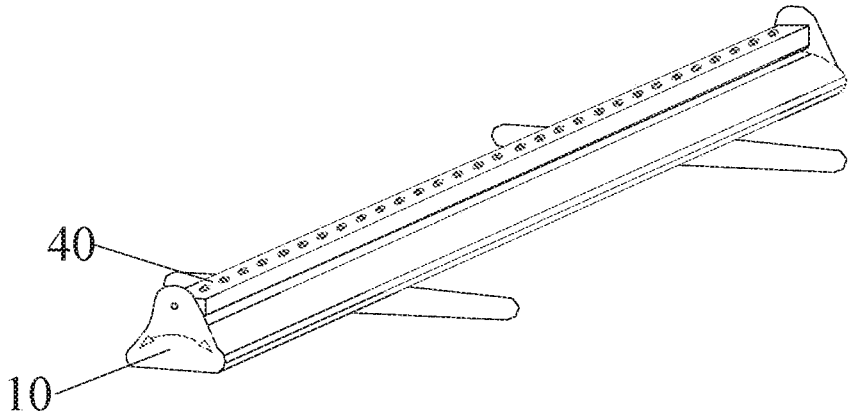
FIG. 5 is a schematic structural diagram of another LED light bar of the present invention.
Figure 6:
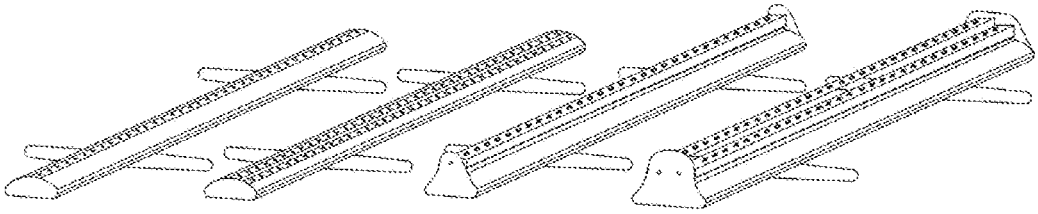
FIG. 6 is a schematic structural diagram of various LED light bars of the present invention.

As shown in FIG. 4 to FIG. 6, the LED light bar 40 has at least one row of LED beads.

In the embodiment, the LED light bar 40 is adjustably embedded in the interior of the base 10 and/or the top supporting element 30; and similarly, the LED light bar 40 is rotatably fixed to the exterior of the base 10 and/or the top supporting element 30.

Furthermore, the LED light bar 40 embedded in the interior or the exterior of the base 10 can be designed to be one-row or dual-row.

In the embodiment, the LED light bar 40 inside or outside the top supporting element 30 similarly can utilize a one-row or two-row structure.

Or, the LED light bar 40 is simultaneously respectively mounted on the top supporting element 30 and the base 10 to form a relative-irradiation light source, for example, one row of the LED light bar 40 is mounted on the base 10, and one row of the LED light bar 40 is mounted on the top supporting element 30; two rows of the LED light bars 40 are mounted on the base 10, and one row of the LED light bar 40 is mounted on the top supporting element 30; and two rows of the LED light bars 40 are mounted on the base 10, and two rows of the LED light bars 40 are mounted on the top supporting element 30.

Figure 7:
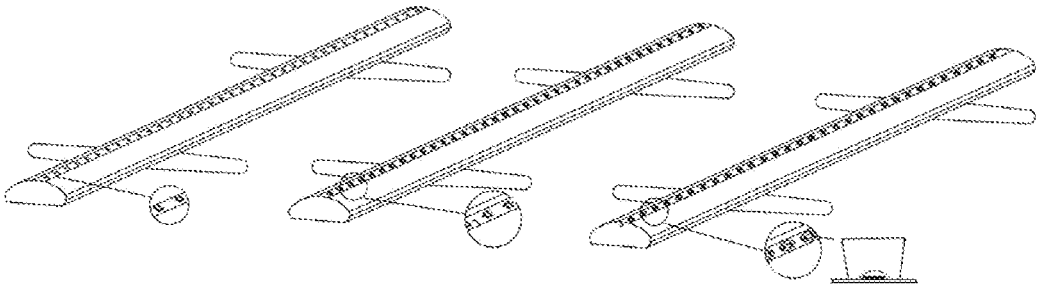
FIG. 7 is a schematic structural diagram of an LED bead of the present invention.

As shown in FIG. 7, the LED bead on the LED light bar 40 includes, but is not limited to, a bare LED bead, a primary optical LED bead and a secondary optical LED bead; and the shape of a lens of the secondary optical LED bead includes, but is not limited to, a circle, an ellipse and a rectangle.

Figure 8:
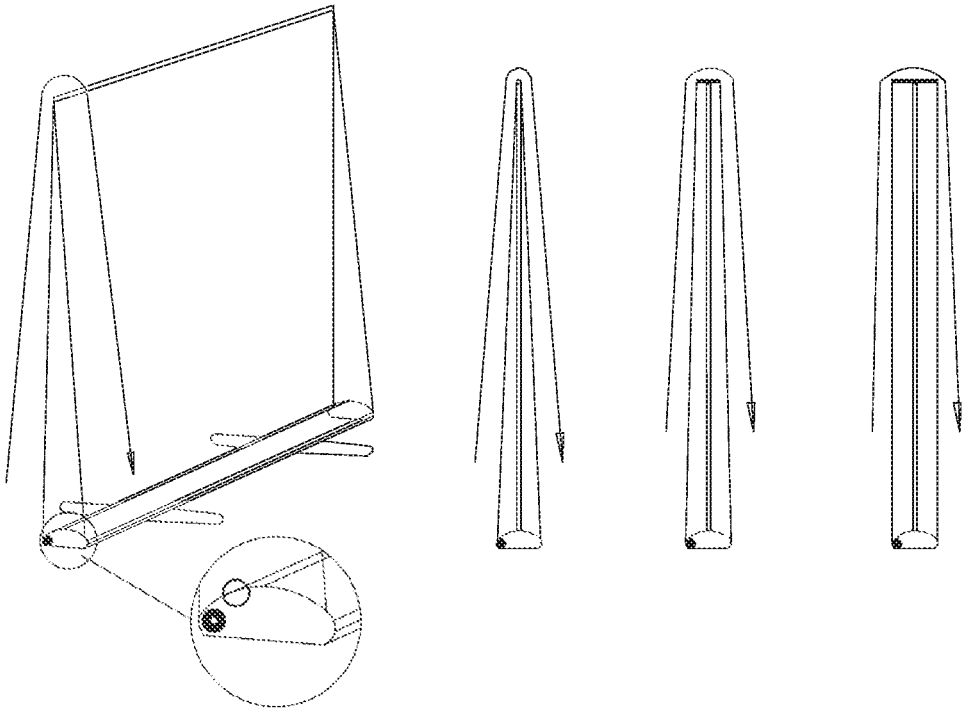
FIG. 8 is a schematic structural diagram of a double-sided uniaxial rapid and simple LED display light box of the present invention.
Figure 9:
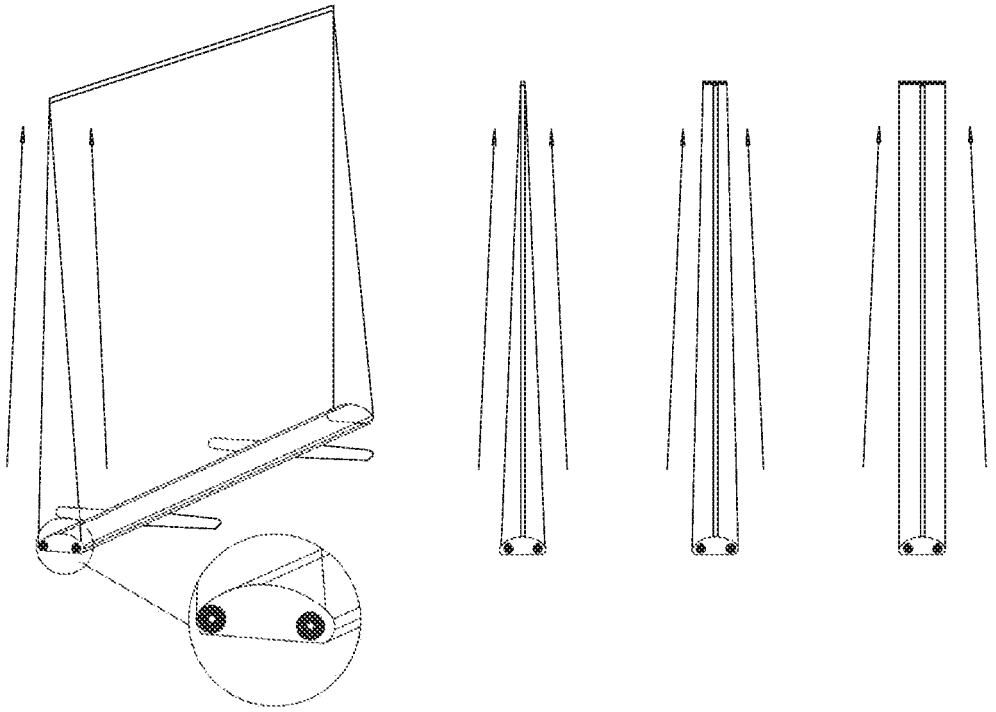
FIG. 9 is a schematic structural diagram of a double-sided biaxial rapid and simple LED display light box of the present invention.

As shown in FIG. 8 and FIG. 9, the rapid and simple LED display light box has a one-sided uniaxial, double-sided uniaxial or double-sided biaxial structure.

Figure 10:
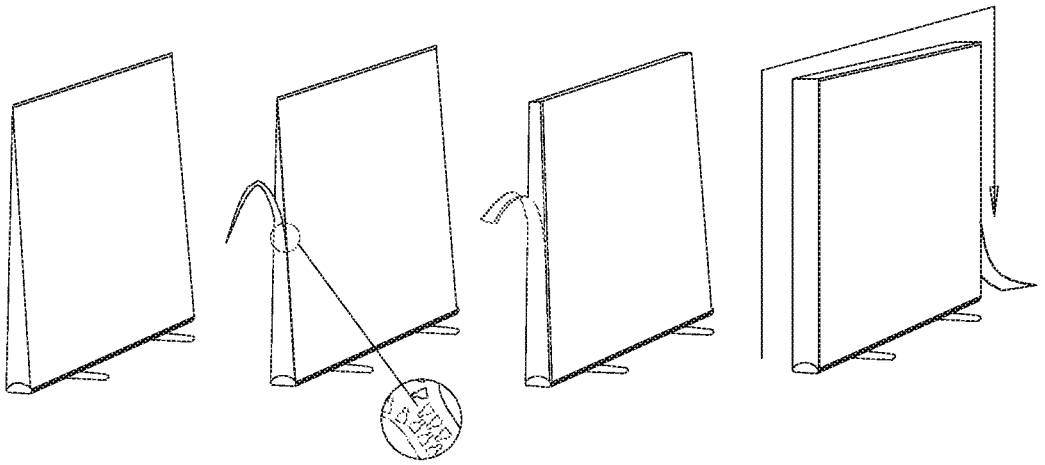
FIG. 10 is a schematic structural diagram of a seal in form of a hook-and-loop fastener according to the present invention.
Figure 11:
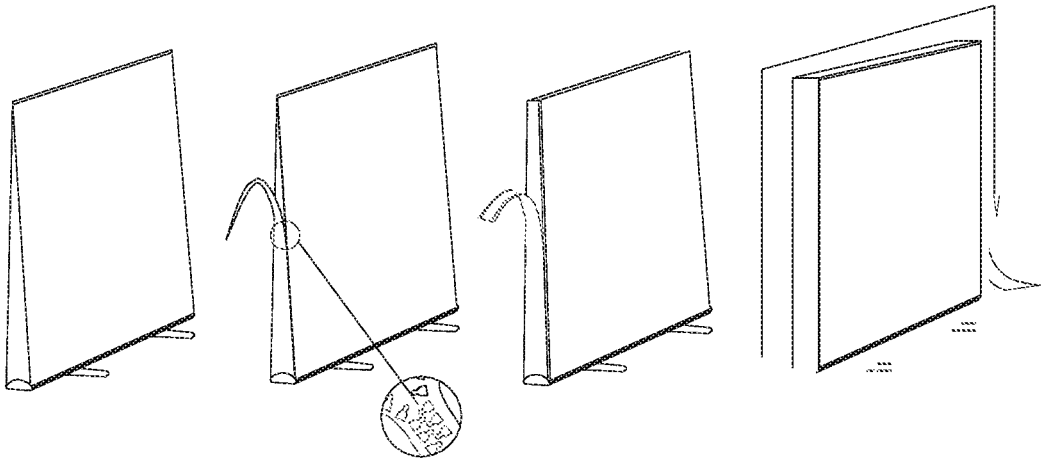
FIG. 11 is a schematic structural diagram of a seal in form of a zipper according to the present invention.
Figure 12:
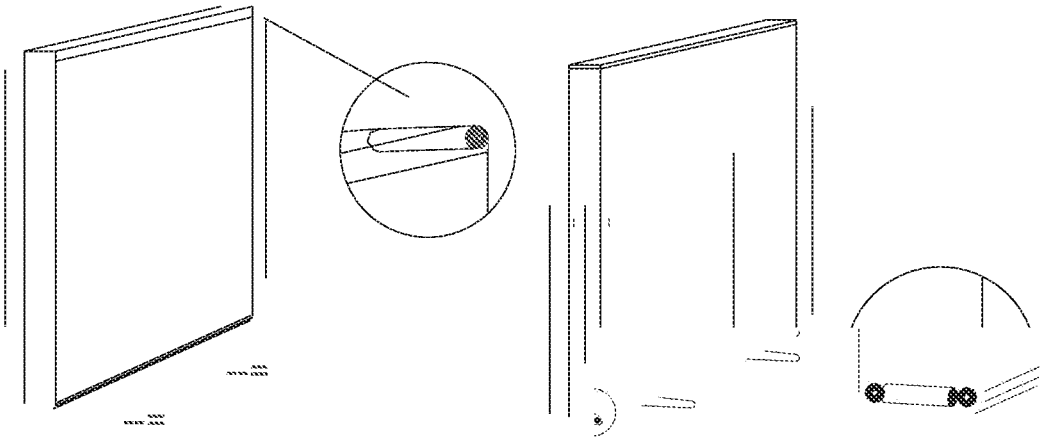
FIG. 12 is a schematic structural diagram of a seal in form of a roller shutter according to the present invention.

As shown in FIG. 10 to FIG. 12, seals are arranged on two sides of the rapid and simple LED display light box; after the seals are arranged, the interior of the rapid and simple LED display light box cannot be seen such that the rapid and simple LED display light box is more beautiful; and the seals are fixed in a hook-and-loop fastener manner, a zipper manner or a roller shutter manner. A roller of the roller shutter is mounted on a side face of the top supporting element 30 or the base 10.

Figure 13:
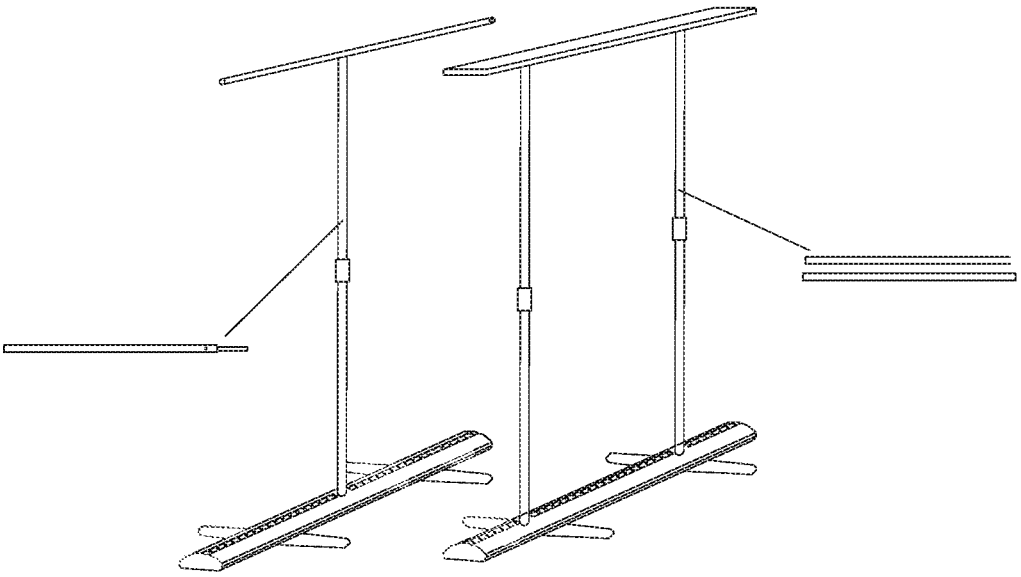
FIG. 13 is a schematic structural diagram of a support rod of the present invention.

As shown in FIG. 13, the number of the support rod 20 is one at least. The support rod 20 can be manufactured to have a retractable structure similar to an umbrella pole or a folding-collection type structure in which a rubber band penetrates through tubes to connect them such that the tubes can be quickly assembled and can be folded during collection.

As shown in FIG. 1, a storage battery system 50 is arranged in the base 10, the storage battery system 50 and the LED light bar 40 are interconnected, and the storage battery system 50 is a lead-acid battery or a lithium battery.

The storage battery system 50 can be inserted into the base 10, the storage battery system 50 can supply power to the LED light bar 40, and the storage battery system 50 can be taken out. The storage battery system 50 can be charged in the base 10 and can also be charged after being taken out.

The foregoing displays and describes the basic principles, the main features and the advantages of the present invention. Persons skilled in the art should know that the present invention is not limited by the above embodiments. The above embodiments and the specification merely describe the principle of the present invention. The present invention further has various changes and improvements without departing from the principle of the present invention, and these changes and improvements should fall in the protection scope of the present invention. the protection scope of the present invention is limited by the appended claims and their legal equivalents.

What is claimed is:

1. A rapid and simple LED display light box, comprising a base, a support rod and a top supporting element, wherein one end of the support rod is fixed to the base while the other end thereof is connected to the top supporting element, and an LED light bar is arranged on the base and/or the top supporting element, wherein the rapid and simple LED display light box has a one-sided uniaxial, double-sided uniaxial or double-sided biaxial structure.

2. The rapid and simple LED display light box according to claim 1, wherein a storage battery system is arranged in the base, the storage battery system and the LED light bar are interconnected, and the storage battery system is a lead-acid battery or a lithium battery.

3. The rapid and simple LED display light box according to claim 1, wherein the shape of a side face of the rapid and simple LED display light box includes, but is not limited to, a rectangle, a trapezoid and a triangle.

4. The rapid and simple LED display light box according to claim 1, wherein the LED light bar has at least one row of LED beads.

5. The rapid and simple LED display light box according to claim 1, wherein the LED light bar is adjustably embedded in the base and/or the top supporting element.

6. The rapid and simple LED display light box according to claim 1, wherein the LED light bar is rotatably fixed to the exterior of the base and/or the top supporting element.

7. The rapid and simple LED display light box according to claim 1, wherein the LED bead on the LED light bar includes, but is not limited to, a bare LED bead, a primary optical LED bead and a secondary optical LED bead.

8. The rapid and simple LED display light box according to claim 6, wherein the shape of a lens of the secondary optical LED bead includes, but is not limited to, a circle, an ellipse and a rectangle.

9. The rapid and simple LED display light box according to claim 1, wherein there is at least one support rod.

10. The rapid and simple LED display light box according to claim 1, wherein the support rod has a retractable structure or a folding-collection type structure.

11. The rapid and simple LED display light box according to claim 1, wherein the top supporting element has a rectangular structure formed by splicing support rod structures, supporting plate structures or tube-shaped structures.

12. The rapid and simple LED display light box according to claim 1, wherein seals are arranged on two sides of the rapid and simple LED display light box, and the seals are fixed using a hook-and-loop fastener, a zipper or a roller shutter.

13. The rapid and simple LED display light box according to claim 12, wherein a roller of the roller shutter is mounted on a side face of the top supporting element or the base.

* * * * *